US008117671B2

(12) United States Patent
Kim

(10) Patent No.: US 8,117,671 B2
(45) Date of Patent: Feb. 21, 2012

(54) NECKTIE

(75) Inventor: Cin Kim, Alpine, NJ (US)

(73) Assignee: Peacock Apparel Group, Inc., New York, NY (US)

( * ) Notice: Subject to any disclaimer, the term of this patent is extended or adjusted under 35 U.S.C. 154(b) by 290 days.

(21) Appl. No.: 12/402,529

(22) Filed: Mar. 12, 2009

(65) Prior Publication Data

US 2009/0265833 A1 Oct. 29, 2009

Related U.S. Application Data

(60) Provisional application No. 61/047,831, filed on Apr. 25, 2008.

(51) Int. Cl.
*A41D 25/00* (2006.01)

(52) U.S. Cl. ..... 2/144

(58) Field of Classification Search ..... 24/49.1, 24/66.11; 2/144–151, 152.1, 153–157
See application file for complete search history.

(56) References Cited

U.S. PATENT DOCUMENTS

| | | | | |
|---|---|---|---|---|
| 2,174,966 | A * | 10/1939 | Campagnoli | 2/146 |
| 5,870,776 | A * | 2/1999 | Blackman | 2/144 |
| 6,233,741 | B1 * | 5/2001 | Loree et al. | 2/157 |
| 7,698,748 | B2 * | 4/2010 | Kim | 2/144 |

* cited by examiner

*Primary Examiner* — Tejash Patel
(74) *Attorney, Agent, or Firm* — Leason Ellis LLP

(57) ABSTRACT

According to one exemplary embodiment, a necktie includes a front tie material of elongated shape having first and second end portions including tips and first and second tipping pieces having a periphery complementary to the first and second end portions, respectively. The tipping pieces are peripherally stitched to the first and second end portions so as to form first and second pockets and the tie includes a lining in which end portions thereof extend into the first and second pockets. The first tipping piece and the first end portion of the front tie material are folded along first and second fold lines that are located adjacent the periphery of the lining and along third and fourth fold lines that are located spaced from and further from the lining than the first and second fold lines to cause the first tipping piece and first end portion to be folded over itself and form a pair of once-folded sections. The first tipping piece and the first end portion are folded along fifth and sixth fold lines to cause the once-folded sections to be folded over themselves to form a pair of twice-folded structures. The tie being is along the first and second fold lines to cause the third and fourth fold lines to be placed adjacent another.

10 Claims, 8 Drawing Sheets

FIG. 1
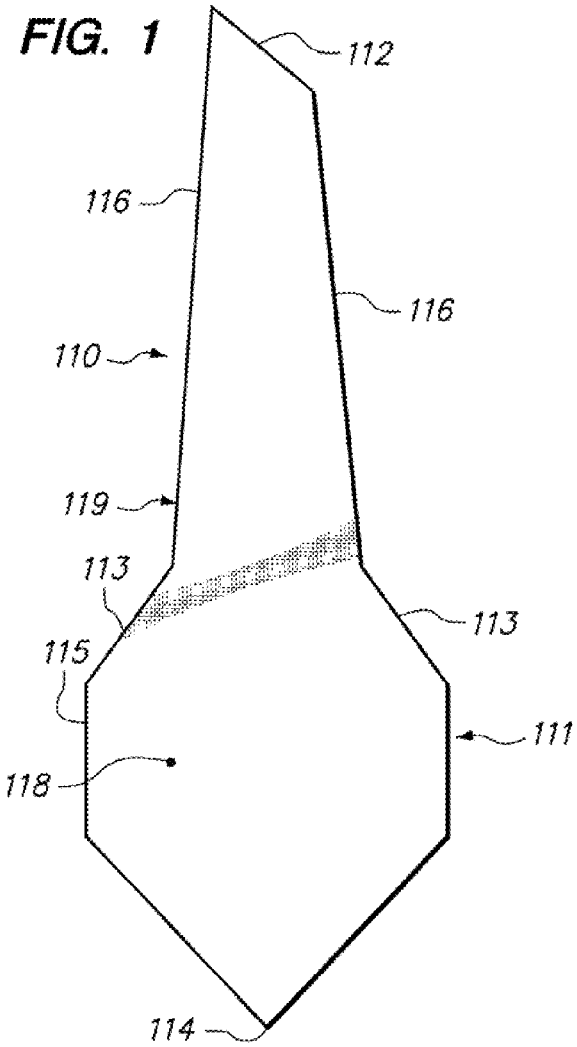
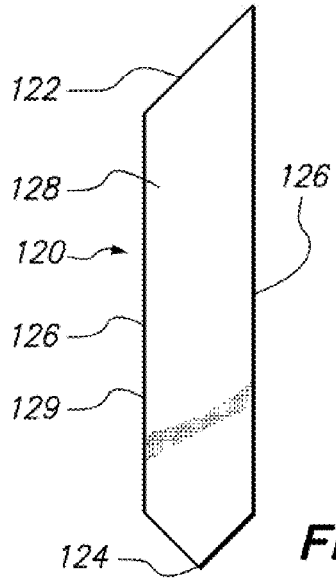
FIG. 2
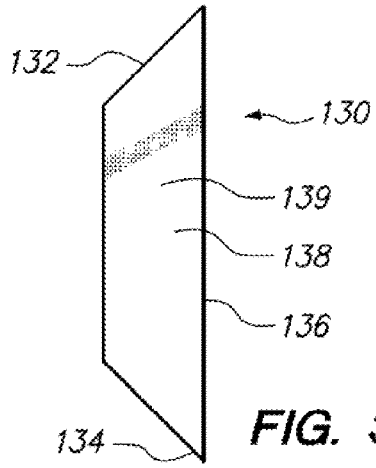
FIG. 3
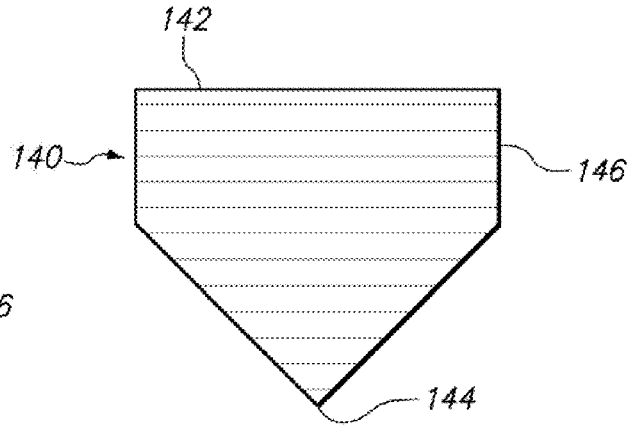
FIG. 4
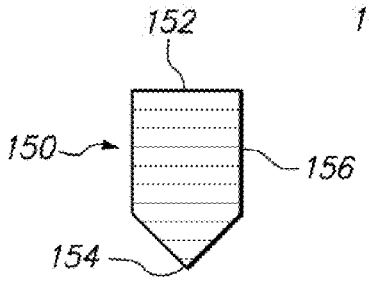
FIG. 5

NECKTIE

CROSS REFERENCE TO RELATED APPLICATIONS

The present application claims the benefit of U.S. patent application Ser. No. 61/047,831, filed Apr. 25, 2008 which is hereby incorporated by reference in its entirety.

TECHNICAL FIELD

The present invention relates to neckties and more particularly, relates to a seven fold necktie and a method of production thereof.

BACKGROUND

A necktie (tie) is a long piece of cloth that is worn around a person's neck. It is designed and intended to rest under a shirt collar and is knotted at the throat. Neckties have been around hundreds of years and the modern necktie descends from a cravat (a piece of fabric worn around the neck and tied in place using strings). While the first neckties were many times solid colors or a white color and devoid of much color, the necktie overtime became more colorful and colors and designs became commonplace with neckties. For example, stripes and paisley patterns were some of the more common and popular designs.

There are a number of different types of neckties. For example, a cravat, as previously mentioned, was simply a brightly colored handkerchief fashioned of silk that was worn around a neck. A four-in-hand necktie originally was a simple, rectangular cloth strip cut on the square, with square ends. The term "four-in-hand" originally described a carriage with horses and a driver and it also referred to a gentlemen's club in London. Original wearers of this type of tie began knotting their ties with a four-in-hand knot. Over time, the four-in-hand knot and the four-in-hand necktie became synonymous and described the long tie or tie that we are familiar with in our culture. These types of ties come in a wide variety of different colors and patterns including, stripes and other decorative patterns, and also, they can come in solid colors.

A seven fold tie is a construction variant of the four-in-hand necktie. Conventionally, a square yard of silk (usually two or more pieces sewn together) is folded to seven sections of silk between the folds. The weight and body of the seven-fold tie derive exclusively from the layering of silk and its construction can be a time consuming task due to the intricate layering and folds. Seven fold ties set themselves apart from the everyday work tie with their superior construction. Each section of the tie is hand stitched with exquisite detail and constructed entirely out or the same silk fabric front to back.

SUMMARY

According to one exemplary embodiment, a necktie includes a front tie material of elongated shape having first and second end portions including tips and first and second tipping pieces having a periphery complementary to the first and second end portions, respectively. The tipping pieces are peripherally stitched to the first and second end portions so as to form first and second pockets, respectively, in cooperation with the first and second end portions of the front tie material. The necktie also includes a lining having a periphery smaller than that of the front tie material and substantially the same as that of the necktie to be produced and formed substantially parallel to the periphery of the front tie material. End portions of the lining extend into the first and second pockets with the periphery of the lining in the pockets being free and unsecured. The first tipping piece and the first end portion of the front tie material are folded along first and second fold lines that are located adjacent the periphery of the lining and along third and fourth fold lines that are located spaced from and further from the lining than the first and second fold lines to cause the first tipping piece and first end portion to be folded over itself and form a pair of once-folded sections. The first tipping piece and the first end portion are folded along fifth and sixth fold lines to cause the once-folded sections to be folded over themselves to form a pair of twice-folded structures. The tie being is along the first and second fold lines to cause the third and fourth fold lines to be placed adjacent another. The necktie also includes a means for attaching the lining to the front tie material along abutting opposite longitudinally extending peripheral inner edges that define the third and fourth fold lines.

In another embodiment, a method for constructing a seven fold tie includes the steps of: (a) providing a front tie material having an elongated shape including first and second end portions including tips; (b) attaching first and second tipping pieces to the first and second end portions along complementary peripheries thereof so as to form first and second pockets, respectively, in cooperation with the first and second end portions of the front tie material; (c) inserting end portions of a lining into the first and second pockets with a periphery of the lining in the pockets being free and unsecured, the lining having a periphery smaller than that of the front tie material and substantially the same as that of the necktie to be produced and formed substantially parallel to the periphery of the front tie material; (d) folding the first tipping piece and the first end portion of the front tie material along first and second fold lines that are located adjacent the periphery of the lining and along third and fourth fold lines that are located spaced from and further from the lining than the first and second fold lines to cause the first tipping piece and first end portion to be folded over itself and form a pair of once-folded sections; (e) folding the once-folded sections along fifth and sixth fold lines to cause the once-folded sections to be folded over themselves to form a pair of twice-folded structures; (f) folding the tie being folded along the first and second fold lines to cause the third and fourth fold lines to be placed adjacent another; and (g) attaching the lining to the front tie material along abutting opposite longitudinally extending peripheral inner edges that define the third and fourth fold lines.

BRIEF DESCRIPTION OF THE DRAWING FIGURES

The foregoing and other features and advantages of the present invention will be more readily apparent from the following detailed description and drawings of the illustrative embodiments of the invention wherein like reference numbers refer to similar elements and in which:

FIG. 1 is an elevation view of a front portion of fabric that is used to manufacture a seven fold necktie in accordance with one embodiment of the present invention;

FIG. 2 is an elevation view of an end portion of fabric;

FIG. 3 is an elevation view of a middle portion of fabric;

FIG. 4 is an elevation view of a tipping lining for the front of the tie;

FIG. 5 is an elevation view of a tipping lining of the back of the tie;

DETAILED DESCRIPTION OF EMBODIMENTS

Figure 15:
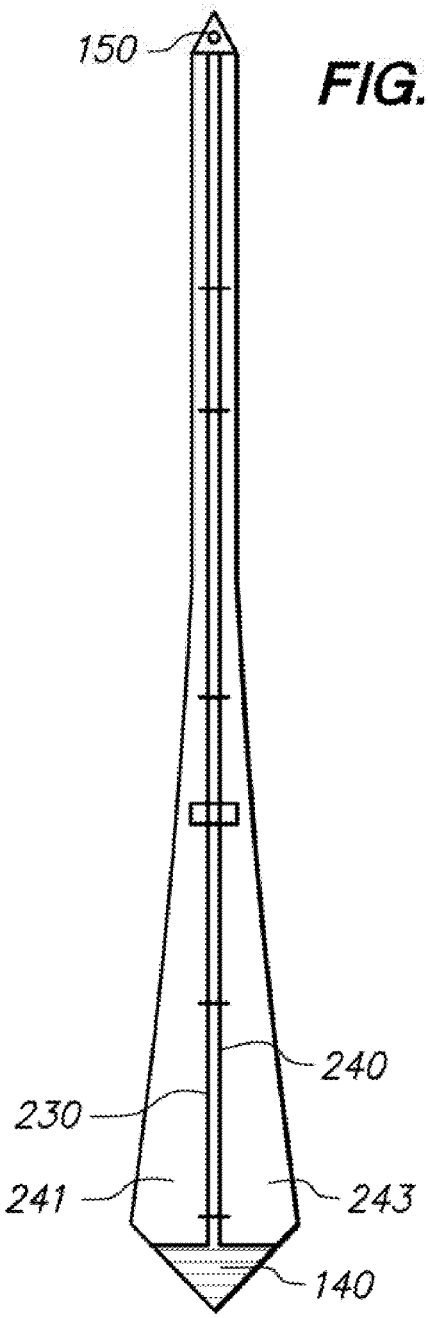
FIG. 15 is an elevation rear view of the assembled seven fold necktie.
Figure 16:
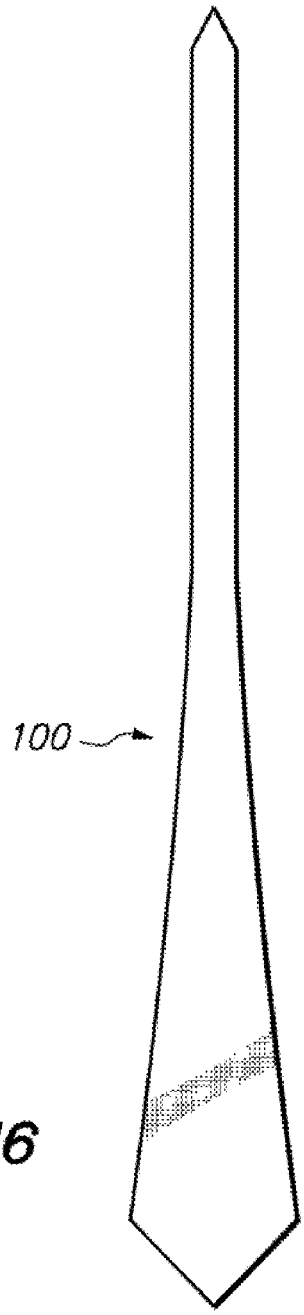
FIG. 16 is an elevation front view of the assembled seven fold necktie.

FIG. 16 is an elevation view of a seven fold necktie (tie) 100 in accordance with one embodiment of the present invention. FIGS. 1-16 illustrate the various parts that makeup the necktie 100 and also illustrate an exemplary method for manufacturing the necktie 100. FIG. 1 shows a front portion 110 that is used in the manufacture of the necktie 100. In particular, the front portion 110 is one of the sections of the necktie 100 that is outwardly visible when the necktie 100 is worn around the neck of a person. The front portion 110 includes a first end 112 and an opposing second end 114 and is further defined by two side edges 116 that extend between the two ends 112, 114. The front portion 110 also includes a front (forward) side or face 18 that is visible and faces away from the wearer's body. The front portion 110 also includes a rear side or face 119. The front face 118 can be formed in any number of different colors and can come in any number of different decorative patterns, including stripes, polka dots, repeating geometric patterns, solids, etc.

As with conventional necktie design, the front portion 110 has a tapered construction in that the second end 114 is wider than the first end 112 since the second end 114 represents the bottom section of the necktie 100 that is worn near the waist of the wearer. In addition to the tapered design, the front portion 110 has a pair of flared edges 113 (e.g., outwardly flared edges) that lead to a pair of lower parallel edges 15 that lead to the V-shaped second end 114. The front portion 110 has a maximum width between the parallel edges 115. The extra width between the edges 115 due to the flared edges 113 defines two areas, generally indicated at 111 of excess or extra side material.

The first end 112 is defined by an angled, cut edge. For example, the first end 112 slopes downwardly from left to right. The second end 114 represents one end of the completed (assembled) necktie 100 and therefore has a V-shape defined by two converging edges.

FIG. 2 shows an end portion 120 that is used in the manufacture of the necktie 100. In particular, the end portion 120 is one of the portions of the necktie 100 that can be outwardly visible when the necktie 100 is worn around the neck of a person. The end portion 120 includes a first end 122 and an opposing second end 124 and is further defined by two side edges 126 that extend between the two ends 122, 124. The end portion 120 also includes a front (forward) side or face 128 that is visible and faces away from the wearer's body. The end portion 120 also includes an opposite rear face 129. The front face 128 preferably is decorated in the same manner as the front face 118. Unlike the front portion 10, the side edges 126 of the end portion 120 are at least substantially parallel to one another since the end portion 120 does not include the taper of the front portion 110.

The first end 122 is similar to the first end 112 in that it is defined by a angled, cut edge. In the illustrated embodiment, the first end 122 slopes upwardly from left to right as shown in FIG. 2. The second end 124 represents one end of the completed (assembled) necktie 100 and therefore has a V-shape defined by two converging edges.

FIG. 3 shows a middle portion 130 that is used in the manufacture of the necktie 100. In particular, the middle portion 130 is one of the portions of the necktie 100 that can be outwardly visible when the necktie 100 is worn around the neck of a person. The middle portion 130 includes a first end 132 and an opposing second end 134 and is further defined by two side edges 136 that extend between the two ends 132, 134. The middle portion 130 also includes a front (forward) side or face 138 that is visible and faces away from the wearer's body. The middle portion 130 also includes an opposite rear side or face 139. The front face 138 preferably is decorated in the same manner as the front face 118 and front face 128. Unlike the front portion 110, the side edges 136 of the middle portion 130 are at least substantially parallel to one another since the middle portion 130 does not include the distinct taper of the front portion 110.

FIG. 4 illustrates a first tipping lining 140 that is intended for the front of the necktie 100. The first tipping lining 140 includes a first end 142 and an opposing second end 144 and is further defined by two side edges 146 that extend between the two ends 142, 144. The first tipping lining 140 has a shape that is complementary to the second end 114 of the front portion 110. As a result, the first end 142 is a straight cut edge that extends between the two side edges 146 and is formed perpendicular to the two side edges 146. The second end 144 has a V-shape that is defiled by two converging angled edges. The first tipping lining 140 can have a different appearance compared to the appearance of the front portion 110. For example, the first tipping lining 140 can be formed of a different color and/or contain a different decorative appearance that the front portion 110. In the illustrated embodiment, the stripe pattern is formed on the first tipping lining 140.

FIG. 5 illustrates a second tipping lining 150 that is intended for the front of the necktie 100. The second tipping lining 150 includes a first end 152 and an opposing second end 154 and is further defined by two side edges 156 that extend between the two ends 152, 154. The second tipping lining 150 has a shape that is complementary to the second end 124 of the end portion 120. As a result, the first end 152 is a straight cut edge that extends between the two side edges 156 and is formed perpendicular to the two side edges 156. The second end 154 has a V-shape that is defined by two converging angled edges. The second tipping lining 150 can have a different appearance compared to the appearance of the end portion 120. For example, the second tipping lining 150 can be formed of a different color and/or contain a different decorative appearance than the end portion 120. In the illustrated embodiment, the stripe pattern is formed on the second tipping lining 150.

Figure 6:
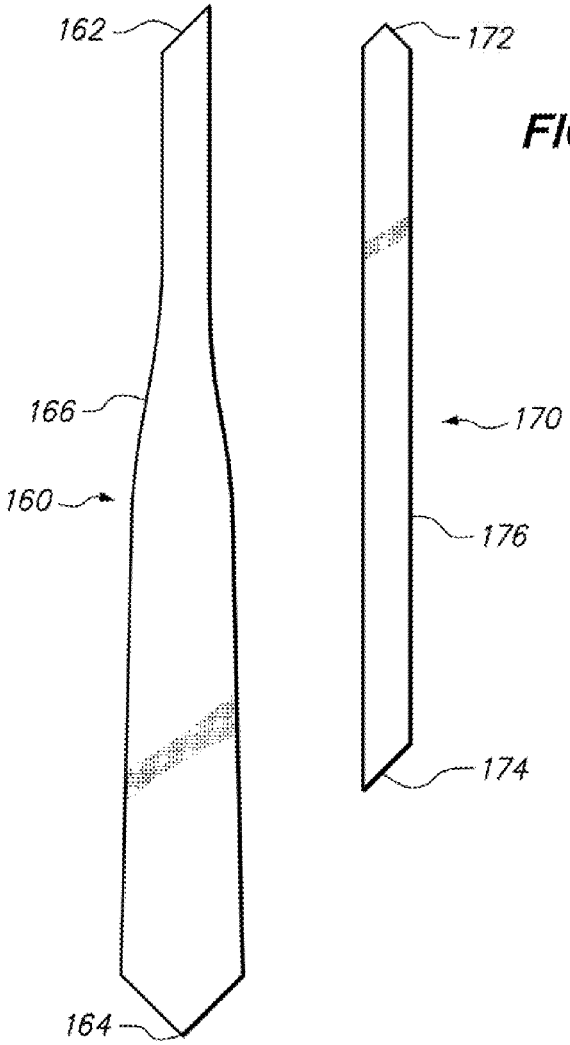
FIG. 6 is an elevation view of interlining for the tie.

FIG. 6 illustrates a pair of interlining pieces and in particular, first and second interlining pieces 160, 170, respectively, are shown. The first interlining piece 160 includes a first end 162 and an opposing second end 164 and is further defined by two side edges 166 that extend between the two ends 162, 164. Similar to the front portion 110, the first interlining piece 160 has a tapered construction in that the second end 164 is wider than the first end 162 since the second end 164 represents the bottom section of the necktie 100 that is worn near the waist of the wearer. The first end 162 is defined by an angled, cut edge. For example, the first end 162 slopes upwardly from left to right. The second end 164 represents one end of the completed (assembled) necktie 100 and therefore has a V-shape defined by two converging edges.

The second interlining piece 170 includes a first end 172 and an opposing second end 174 and is further defined by two side edges 176 that extend between the two ends 172, 174. The second interlining piece 170 is designed to mate with the end portion 120 and the middle portion 130 and consequently has a similar shape. The second interlining piece 170 can have a slightly tapered construction in that the second end 174 can be slightly wider than the first end 172. The second end 174 is defined by an angled, cut edge, while the first end 172 represents one end of the completed (assembled) necktie 100 and therefore has a V-shape defined by two converging edges.

The first and second interlining pieces 160, 170 can come in a variety of different colors and can have any number of different decorative patterns. For example, the first and second interlining pieces 160, 170 have a colorful decorative pattern that is different than the colors and pattern of the portions 110, 120, 130. For example, the interlining pieces 160, 170 can have a decorative stripe pattern.

Figure 7:
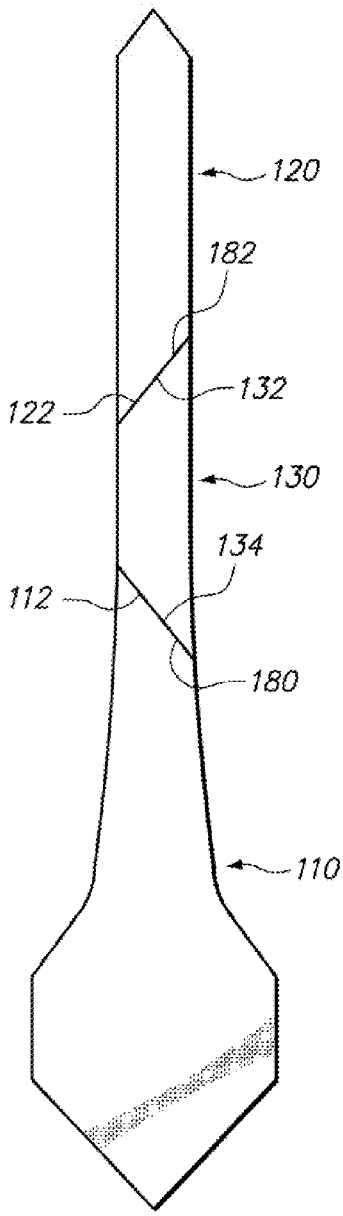
FIG. 7 is an elevation view of a first step of constructing the seven fold necktie.

FIG. 7 shows a first step for constructing the necktie 100 of the present invention. In this step, the front portion 110, end portion 120 and the middle portion 130 are joined together. More specifically, the second end 134 of the middle portion 130 is joined to the first end 112 of the front portion 110 along a first coupling line 180 and the first end 132 of the middle portion 130 is joined to the first end 122 of the end portion 120 along a second coupling line 182. The three portions 110, 120, 130 can be joined together using any number of different techniques, including using a sewing or stitching process. When a stitching process is used, the first and second coupling lines 180, 182 can be thought of as first and second sewing lines or stitching lines. It will be appreciated that when the three parts 110, 120, 130 are arranged for being joined to one another, the front faces 118, 128, 138 all face outward. The first and second sewing lines 180, 182 have different cut orientations since as shown in FIG. 7, the slopes of the two are opposite resulting in the axes of each sewing line convering.

Figure 8:
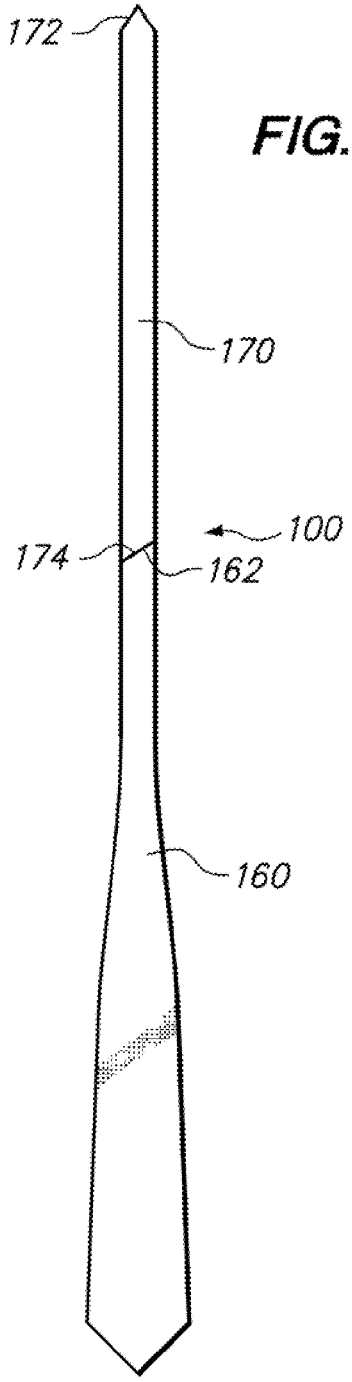
FIG. 8 is an elevation view of a second step of constructing the seven fold necktie.

FIG. 8 shows a second step for constructing the necktie 100 of the present invention. In this step, the second end 174 of the second interlining piece 170 is joined to the first end 162 of the first interlining piece 160. As with the above process, the first and second interlining pieces 160, 170 can be joined together using a sewing or stitching process. The joined first and second interlining pieces 160, 170 has a similar shape and similar dimensions relative to the completed necktie 100 since the joined pieces 160, 170 serve as the interlining material for the necktie 100.

Figure 9:
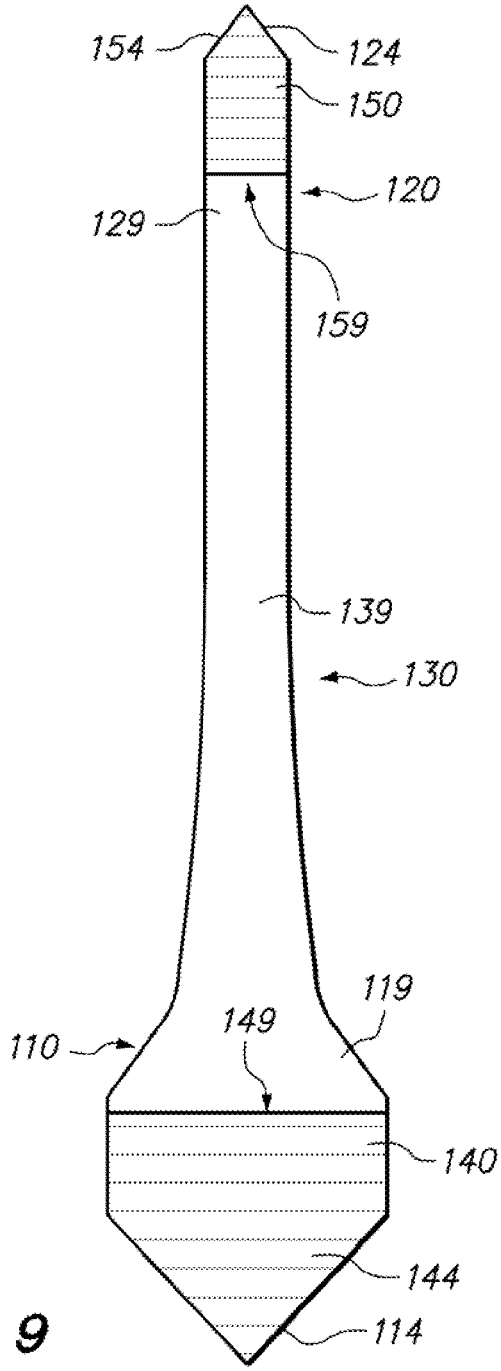
FIG. 9 is an elevation view of a third step of constructing the seven fold necktie.

FIG. 9 shows a third step for constructing the necktie 100. The connected portions 110, 120, 130 are flipped over (reversed) such that the rear surfaces 119, 129, 139 face upward and the first tipping lining 140 is then placed on top of the necktie 100. In particular, the first tipping lining 140 is laid over the rear face 119 of the front portion 110 such that the second end 144 is superimposed over the second end 114 of the front portion 110. The first tipping lining 140 is then securely attached to the front portion 110 using conventional techniques, such as the use of stitching. For example, stitching can be provided along some of the perimeter edges of the first tipping lining 140 resulting in it being securely stitched to the second end area of the front portion 110. However, the top edge of the first tipping lining 140 is not stitched across so as to create a first pocket 149 between the lining 140 and the underlying fabric of the front portion 110.

Similarly, as shown in FIG. 9, the second tipping lining 150 is disposed on the rear face 129 of the end portion 120 such that the second end 154 of the second tipping lining 150 is superimposed over the second end 124 of the end portion 120. The second tipping lining 150 is then securely attached to the end portion 120 using conventional techniques, such as stitching the second tipping lining 150 along some of its perimeter edges. However, the top edge of the second tipping lining 150 is not completely stitched so as to create a second pocket 159 between the lining 150 and the underlying fabric of the end portion 120.

Figure 10:
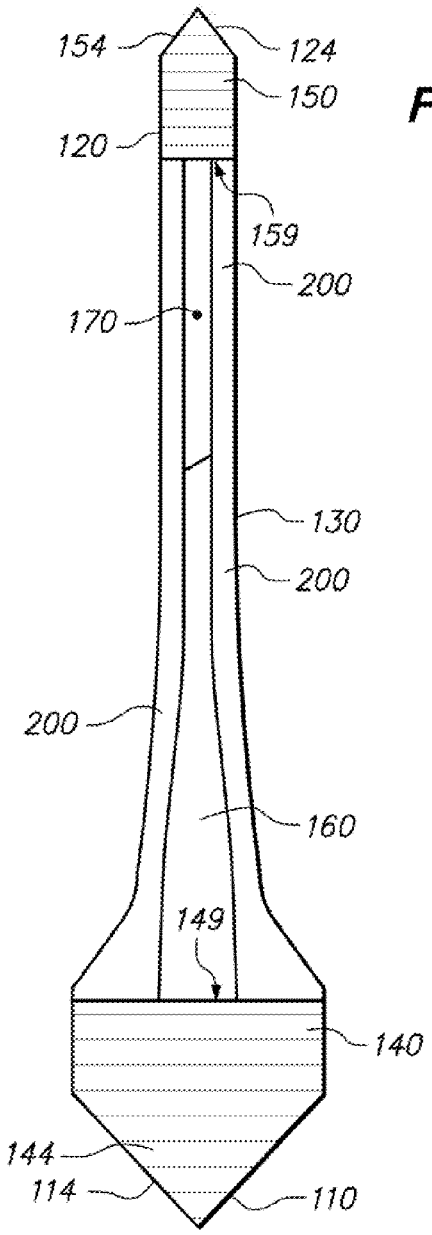
FIG. 10 is an elevation view of a fourth step of constructing the seven fold necktie.

FIG. 10 is a bottom view of the necktie 100. In addition, in this configuration, the first and second tipping linings 140, 150 thus face upwardly as shown in FIG. 10. It will also be appreciated that in FIG. 10, edges of the front portion 110 and edges of the end portion 120 can be folded so as to slightly cover the peripheral edges of the first and second tipping linings, respectively. This provides a neat, clean finish.

FIG. 10 shows a fourth step where the assembled first and second interlining pieces 160, 170 are disposed over the rear faces 119, 129, 139 of the portions 110, 120, 130, respectively. The joined first and second interlining pieces 160, 170 are arranged relative to the joined portions 110, 120, 130 by superimposing the first end 172 over the second end 124 and superimposing the second end 164 over the second end 114. In addition, the first end 172 is inserted into the second pocket 159 formed by the second tipping lining 150 so that the pointed second end 172 is placed proximate the pointed ends 154, 124. Similarly, the second end 164 is placed into the first pocket 149 formed by the first tipping lining 140 so that the pointed second end 164 is placed proximate the pointed ends 144, 114.

The width of the joined first and second interlining pieces 160, 170 along its entire length is length than the corresponding width of the joined portions 110, 120, 130 that lie beneath the interlining. This results in a peripheral fabric border 200 being formed around the exposed portions of the pieces 160, 170 that lie outside the pockets defined by the tipping linings 140, 150.

Figure 11:
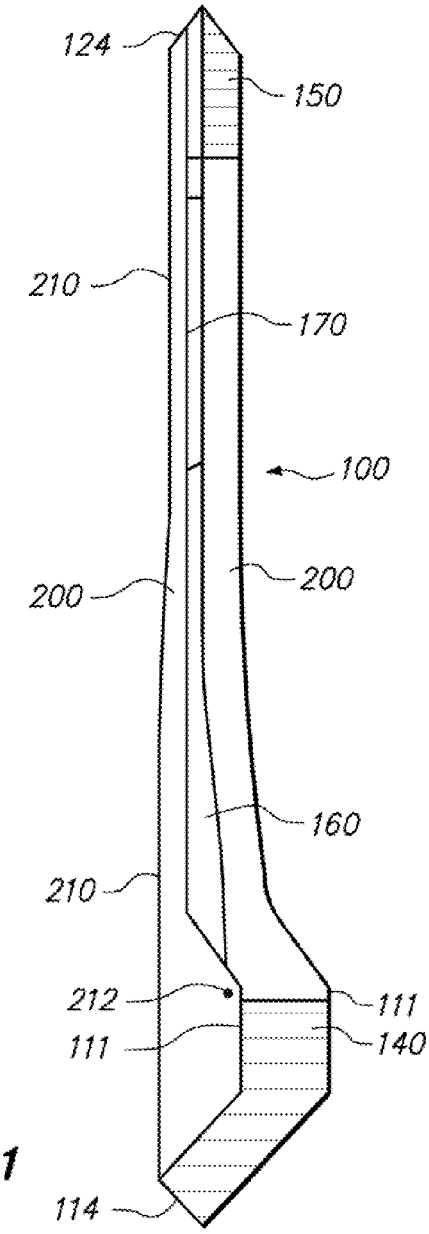
FIG. 11 is an elevation view of a fifth step of constructing the seven fold necktie.

As shown in FIG. 11, in a fifth step, the necktie 100 is folded about a first fold line 210 that extends from the pointed second end 124 to the first end 114. The first fold line 210 does not intersect the point of the second end 124 where the two angled edges converge but is slightly offset therefrom and similarly, the first fold line 210 does not intersect the point of the first end where the two angled edges converge but is slightly offset therefrom. The first fold line 210 is formed so that it lies close to the left edge of the attached first and second interlining pieces 160, 170. In other words, the peripheral border 200 on the left side of the necktie 100 is folded over and the necktie 100 including the extra material 111 of that side is ironed along the first fold line 210. When the necktie 100 is folded in this manner, the folded over left portion 212 of the necktie 100 extends over the pieces 160, 170 and at the front portion 110, the folded over left portion 212 extends at least substantially across the first interlining piece 160. A right side of the first tipping lining 140 is visible.

Figure 12:
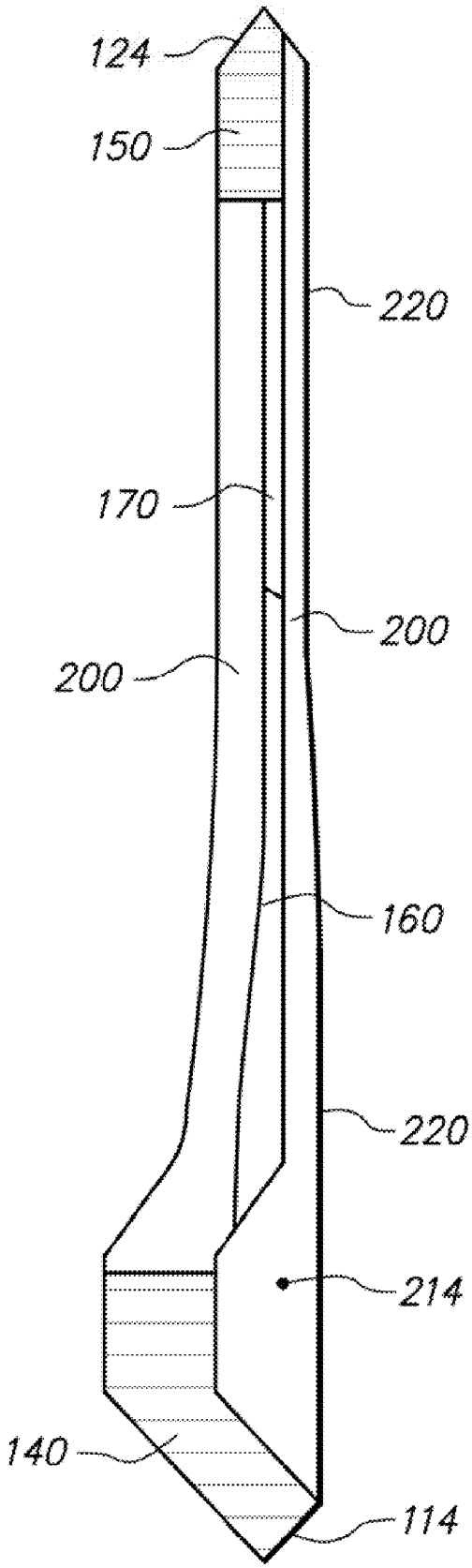
FIG. 12 is an elevation view of a sixth step of constructing the seven fold necktie.

Similarly, as shown in FIG. 12, in a sixth step, the necktie 100 is folded about a second fold line 220 that extends from the pointed second end 124 to the first end 114. The second fold line 220 does not intersect the point of the second end 124 where the two angled edges converge but are spaced slightly therefrom and similarly, the second fold line 220 does not intersect the point of the first end where the two angled edges converge but is spaced slightly therefrom. The second fold line 220 is formed so that it lies close to the right edge of the attached first and second interlining pieces 160, 170. In other words, the peripheral boundary 200 on the right side of the necktie 100 is folded over and the necktie 100 is ironed along the second fold line 220. When the necktie 100 is folded in this manner, the folded over right portion 214 of the necktie 100 extends across the pieces 160, 170 and at the front portion 10, the folded over right portion 214 extends at least substantially across the first interlining piece 160. A left side of the first tipping lining 140 is visible.

It will be appreciated that the first and second fold lines 210, 220 lie close to the side edges of the first and second pieces 160, 170 and extend along a substantial length thereof.

Ironing along the folds creases the fold lines 210, 220.

Figure 13:
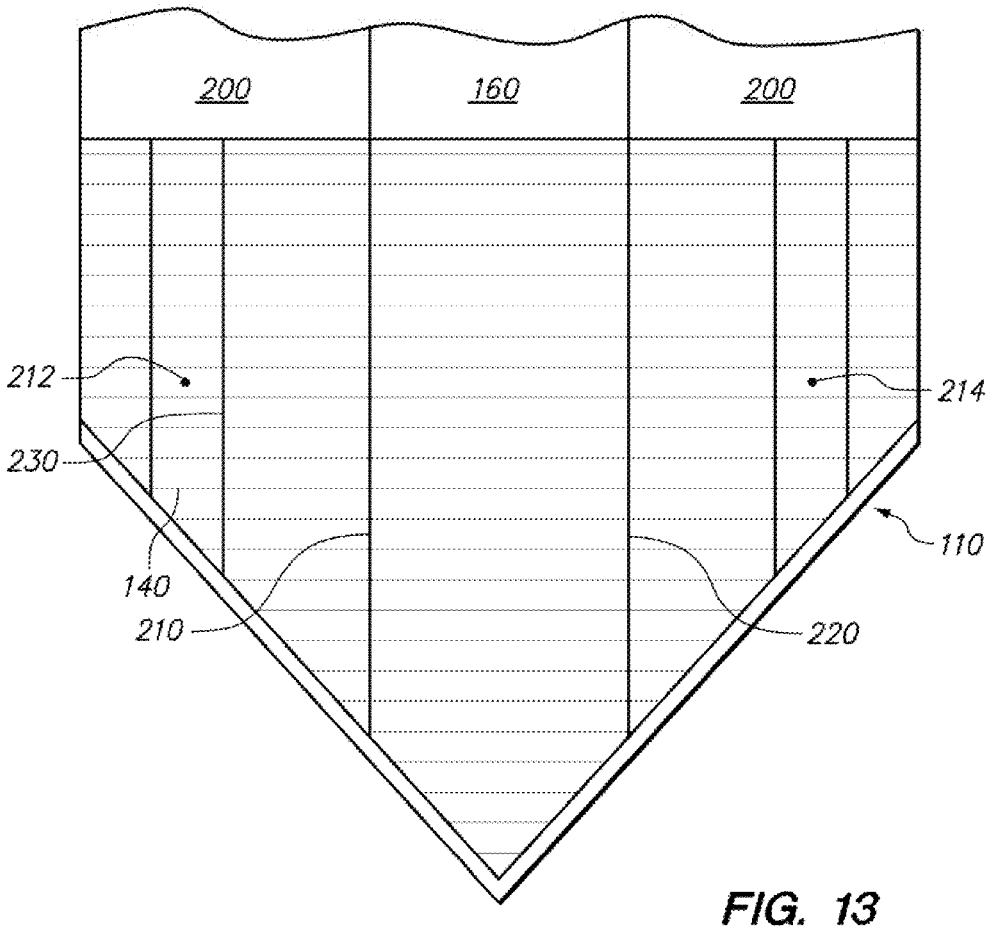
FIG. 13 is an elevation view of a seventh step of constructing the seven fold necktie.

Next, in a seventh step, the folded over left and right portions 212, 214 are folded back open to the position shown in FIG. 13 so that the front portion 110 of the necktie 100 lies substantially flat.

Figure 14:
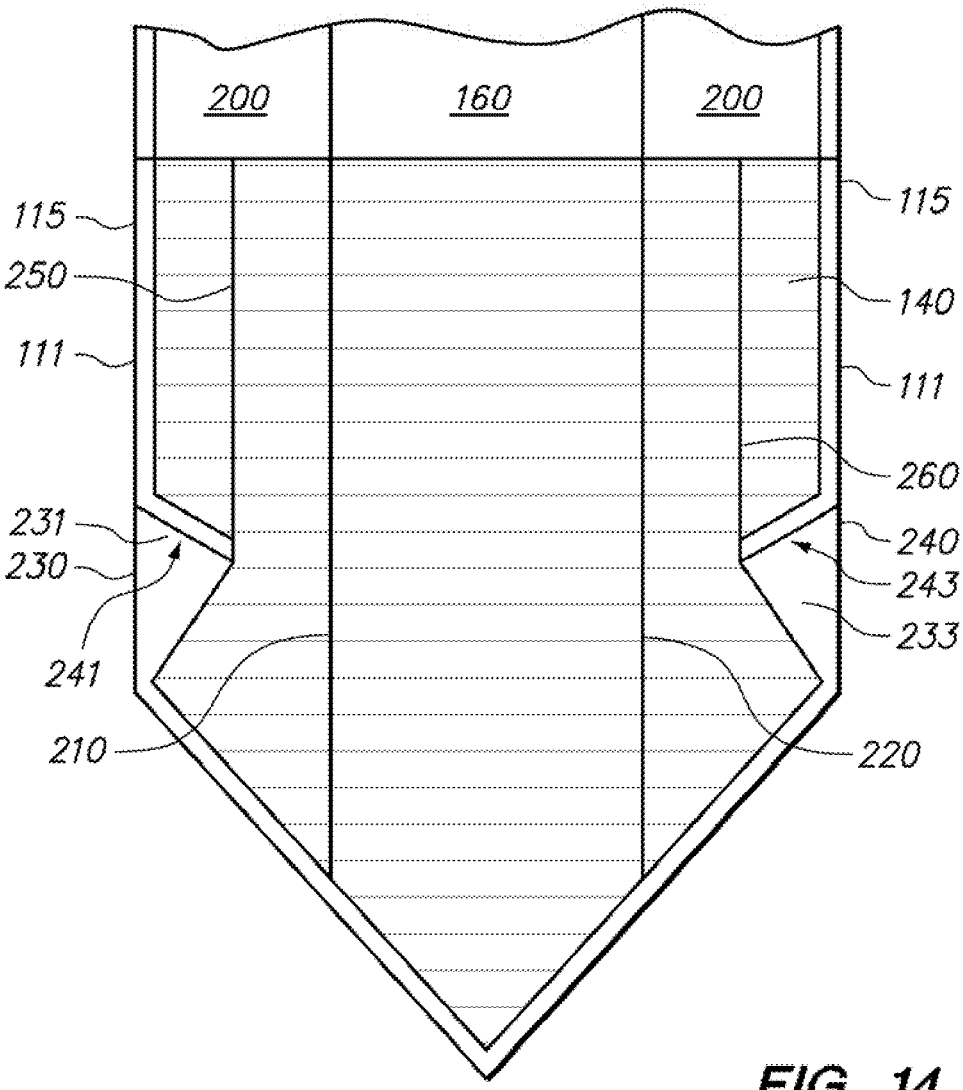
FIG. 14 is an elevation view of an eighth step of constructing the seven fold necktie.

In an eighth step shown in FIG. 14, the front of the necktie 100 is ironed from the front portion 110 to the middle portion 130. In addition, the material that is of the left side of the necktie relative to the pieces 160, 170, including the left side of extra material 111, is folded inward about a third fold line 230 that extends from front portion 110 to the end portion 120 to define a left side folded material 231. The third fold line 230 is located further away from the interlining 160, 170 compared to the first fold line 210. This results in a small section of the necktie fabric being folded over. The edge of the folded over portion of the left side of extra material 111 can lie over the interlining section 160 or it can be close to the left edge of the interlining section 160. The necktie 100 is then ironed about the third fold line 230. In FIG. 14, similarly, the right side of excess material 111 is folded inward about a fourth fold line 240 that is located further away from the interlining 160, 170 compared to the second fold line 220. This results in the formation of a right side folded material 233.

The left side folded material 231 is then folded back on top of itself about a fifth fold line 250 resulting in the edge 115 being brought close to the third fold line 230 of the final necktie construction. As shown in FIG. 14, by folding the material about the fifth line 250, a left double folded structure 241 results. The first, third and fifth fold lines are at least generally parallel one another within the first tipping lining 140 area. Similarly, the right side folded material 233 is then folded back on top of itself about a sixth fold line 260 resulting in the edge 115 being brought close to the fourth fold line 240 of the final necktie construction. As shown in FIG. 14, by folding the material about the sixth line 270, a right double folded structure 243 results. The second, fourth and sixth fold lines are at least generally parallel one another within the First tipping lining area.

As shown in FIG. 15, the right double folded structure 243 is folded inward about the second fold line 220 resulting in the fourth fold line 240 being located in the middle of the first interlining section 160 and defining an inner edge of the tic. This also results in middle portion 130 and the end portion 120 being laid over and covering a portion of the first and second interlining sections 160, 170. This folded structure can then be ironed to set the fold lines 220, 240. The left double folded structure 241 is then folded inward about the first fold line 210 resulting in the third fold line 230 being located generally near the middle of the interlining sections 160, 170 defining the other inner edge of the tic. When the left double folded structure 241 is folded over, the third and fourth fold lines 230, 240 are disposed adjacent one another on top of the first interlining section 160. In the middle portion 130 and end portion 120, the folded left portion overlies the folded right portion.

In this final, complete folded position, shown in FIG. 15, a small portion of the first tipping lining 140 is exposed and in particular, the exposed portion has a diamond shape. Similarly, a small portion of the second tipping lining 150 is exposed and in particular, the exposed portion has a diamond shape. FIG. 15 thus shows the folded rear portion of the tie 100. Stitching or the like can be used at spaced locations to attach the left and right folded portions of the tie together along one center seam.

FIG. 16 is a front elevation view of the finished, complete tie 100.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different points set forth below may be combined various ways in further accordance with the present invention.

What is claimed is:

1. A necktie comprising:

a front tie material of elongated shape having first and second end portions including tips;

first and second tipping pieces having a periphery complementary to the first and second end portions, respectively, the tipping pieces being peripherally stitched to the first and second end portions so as to form first and second pockets, respectively, in cooperation with the first and second end portions of the front tie material;

a lining having a periphery smaller than that of the front tie material and substantially the same as a periphery of the necktie and formed substantially parallel to the periphery of the front tie material, wherein end portions of the lining extend into the first and second pockets with the periphery of the lining in the first and second pockets being free and unsecured, the first tipping piece and the first end portion of the front tie material being folded along first and second fold lines that are located adjacent the periphery of the lining and along third and fourth fold lines that are located spaced from and further from the lining than the first and second fold lines to cause the first tipping piece and first end portion to be folded over itself and form a pair of once-folded sections; the first tipping piece and the first end portion being folded along fifth and sixth fold lines to cause the once-folded sections to be folded over themselves to form a pair of twice-folded structures, the tie being folded along the first and second fold lines to cause the third and fourth fold lines to be placed adjacent another; and means for attaching the lining to the front tie material along abutting opposite longitudinally extending peripheral inner edges that define the third and fourth fold lines.

2. The necktie of claim 1, wherein the first tipping piece is stitched except along an upper edge thereof in an enlarged area of first end portion of the front tie material.

3. The necktie of claim 2, wherein the enlarged area defines a maximum width of the front tie material in an unfolded state and is defined by a pair of substantially parallel side edges.

4. The necktie of claim 3, wherein each parallel side edge is connected at its ends to angled edges.

5. The necktie of claim 1, wherein a section of each of the first and second tipping pieces is exposed at the respective tips of the front tie material.

6. A method for constructing a seven fold tie comprising the steps of:

providing a front tie material having an elongated shape including first and second end portions including tips;

attaching first and second tipping pieces to the first and second end portions along complementary peripheries thereof so as to form first and second pockets, respectively, in cooperation with the first and second end portions of the front tie material;

inserting end portions of a lining into the first and second pockets with a periphery of the lining in the pockets being free and unsecured, the lining having a periphery smaller than that of the front tie material and substantially the same as a periphery of the necktie and formed substantially parallel to the periphery of the front tie material;

folding the first tipping piece and the first end portion of the front tie material along first and second fold lines that are located adjacent the periphery of the lining and along third and fourth fold lines that are located spaced from and further from the lining than the first and second fold lines to cause the first tipping piece and first end portion to be folded over itself and form a pair of once-folded sections;

folding the once-folded sections along fifth and sixth fold lines to cause the once-folded sections to be folded over themselves to form a pair of twice-folded structures;

folding the tie being folded along the first and second fold lines to cause the third and fourth fold lines to be placed adjacent another; and attaching the lining to the front tie material along abutting opposite longitudinally extending peripheral inner edges that define the third and fourth fold lines.

7. The method of claim 6, wherein the front tie material includes an enlarged width area at the first end, the first tipping piece being attached to the front tie material in the enlarged width area thereof.

8. The method of claim 6, wherein the first and second fold lines are substantially adjacent longitudinal edges of the lining.

9. The method of claim 7, wherein the enlarged width area is defined by a pair of substantially parallel edges that define a maximum width of the unfolded front tie material, the once folded and twice-folded structure being formed and folded in the englarged width area.

10. The method of claim 6, wherein the step of folding the first tipping piece and the first end portion of the front tie material along the first fold line results in the once-folded structure extending across the first tipping to a location proximate to or beyond an opposite peripheral edge of the lining and wherein the step of folding the first tipping piece and the first end portion of the front tie material along the second fold line results in the once-folded structure extending across the first tipping to a location proximate to or beyond the first fold line.

* * * * *